US006432002B1

(12) United States Patent
Pavonetti

(10) Patent No.: US 6,432,002 B1
(45) Date of Patent: Aug. 13, 2002

(54) COLLAPSIBLE/PORTABLE SOCCER GOAL

(76) Inventor: Onofrio F. Pavonetti, 78 Dunwoodie St., Scarsdale, NY (US) 10583

( * ) Notice: Subject to any disclaimer, the term of this patent is extended or adjusted under 35 U.S.C. 154(b) by 0 days.

(21) Appl. No.: 09/307,884

(22) Filed: May 10, 1999

Related U.S. Application Data

(63) Continuation-in-part of application No. 08/770,551, filed on Dec. 23, 1996, now Pat. No. 5,902,195, which is a continuation-in-part of application No. 08/354,477, filed on Dec. 12, 1994, now Pat. No. 5,586,768.

(51) Int. Cl.[7] ..... A63B 63/00
(52) U.S. Cl. ..... 473/478; 273/400
(58) Field of Search ..... 273/400, 401, 273/402, 398, 404; 473/476, 478, 472

(56) References Cited

U.S. PATENT DOCUMENTS

| | | | | |
|---|---|---|---|---|
| 4,368,891 A | * | 1/1983 | Neisius | 273/400 |
| 4,407,507 A | * | 10/1983 | Caruso et al. | 273/400 |
| 5,186,469 A | * | 2/1993 | Terris | 273/400 |
| 5,372,368 A | * | 12/1994 | Pavonetti | 273/400 |
| 5,586,768 A | * | 12/1996 | Pavonetti | 273/400 |
| 5,902,195 A | * | 5/1999 | Pavonetti | 273/400 |

FOREIGN PATENT DOCUMENTS

| | | | |
|---|---|---|---|
| DE | 2122323 | * | 11/1972 |
| FR | 2636659 | * | 9/1988 |

* cited by examiner

*Primary Examiner*—Mark S. Graham
(74) *Attorney, Agent, or Firm*—Lackenbach Siegel Marzullo Aronson & Greenspan

(57) ABSTRACT

A collapsible soccer goal, comprising vertical side frame supports, each having a pair of adjacently disposed vertical section. An elongated top beam having a plurality of adjacently disposed horizontal sections including opposite end sections resting atop the pair of vertical sections; and the vertical and horizontal sections are formed as hollow tubular elements with joints, including corner joints formed by the elongated top beam with the pair of vertical sections, and the adjacently disposed sections are all joined together by a plurality of bar means. Each vertical side frame support further includes at least a plurality of adjustable/extendible or telescoping struts; and the plurality of adjustable/extendible or telescoping struts forms a truss-like structure connectable to a vertical section for supporting the vertical and horizontal sections as a unitary soccer goal in a vertical upright position orthogonal to ground.

16 Claims, 18 Drawing Sheets

COLLAPSIBLE/PORTABLE SOCCER GOAL

RELATED PATENT APPLICATIONS

This application is a Continuation-in-Part of my earlier U.S. patent application Ser. No. 08/770,551, filed Dec. 23, 1996, now U.S. Pat. No. 5,902,195, granted May. 11, 1999, which in turn is a Continuation-in-Part of my U.S. patent application Ser. No. 08/354,477, filed Dec. 12, 1994, now U.S. Pat. No. 5,586,768, granted Dec. 24, 1996; which in turn is related to my U.S. patent application Ser. No. 180,282, filed Jan. 12, 1994, now U.S. Pat. No. 5,372,368, granted Dec. 13, 1994, all of which are incorporated herein by reference.

BACKGROUND OF THE INVENTION

FIELD OF THE INVENTION

The invention relates to an improved collapsible or portable soccer goal that can be assembled and disassembled quickly on the field, and which is readily transportable by a person in a car or vehicle as the various components of such soccer goal "break down" into a plurality of smaller elements that can be packaged simply and/or easily handled, stored and transported or shipped.

SUMMARY OF THE INVENTION

The invention is achieved by a collapsible/portable soccer goal, comprising vertical side frame supports, each having a pair of adjacently disposed vertical sections, with an elongated top beam having a plurality of adjacently disposed horizontal sections including opposite end sections resting atop the pair of vertical sections. The vertical and horizontal sections are formed as hollow tubular elements with joints, including corner joints formed by said elongated top beam with said pair of vertical sections, and said adjacently disposed sections joined together by a plurality of bar means. Each vertical side frame support further includes at least a plurality of adjustable/extendible or telescoping struts, and the said plurality of adjustable/extendible or telescoping struts form a truss-like structure connectable to a vertical section for supporting said vertical and horizontal sections as a unitary soccer goal in a vertical upright position orthogonal to the ground.

The invention is also further achieved by a collapsible/portable soccer goal comprising vertical side frame supports, each having a pair of adjacently disposed vertical sections with an elongated top beam having a plurality of horizontal sections including opposite end sections resting atop said pair of vertical sections. The vertical and horizontal sections are formed as hollow tubular elements with joints, including corner joints formed by said elongated top beam with said pair of vertical sections, and said joints adjacently disposed sections joined together by a plurality of bar means. Each vertical side frame support further includes a plurality of fixed length struts and adjustable/extendible or telescoping struts, and each of said plurality of fixed length struts and adjustable/extendible or telescoping struts forms a truss-like structure connectable to a vertical section for supporting said vertical and horizontal sections as a unitary soccer goal in a vertical upright position orthogonal to the ground.

BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF THE PREFERRED EMBODIMENTS

Figure 1:
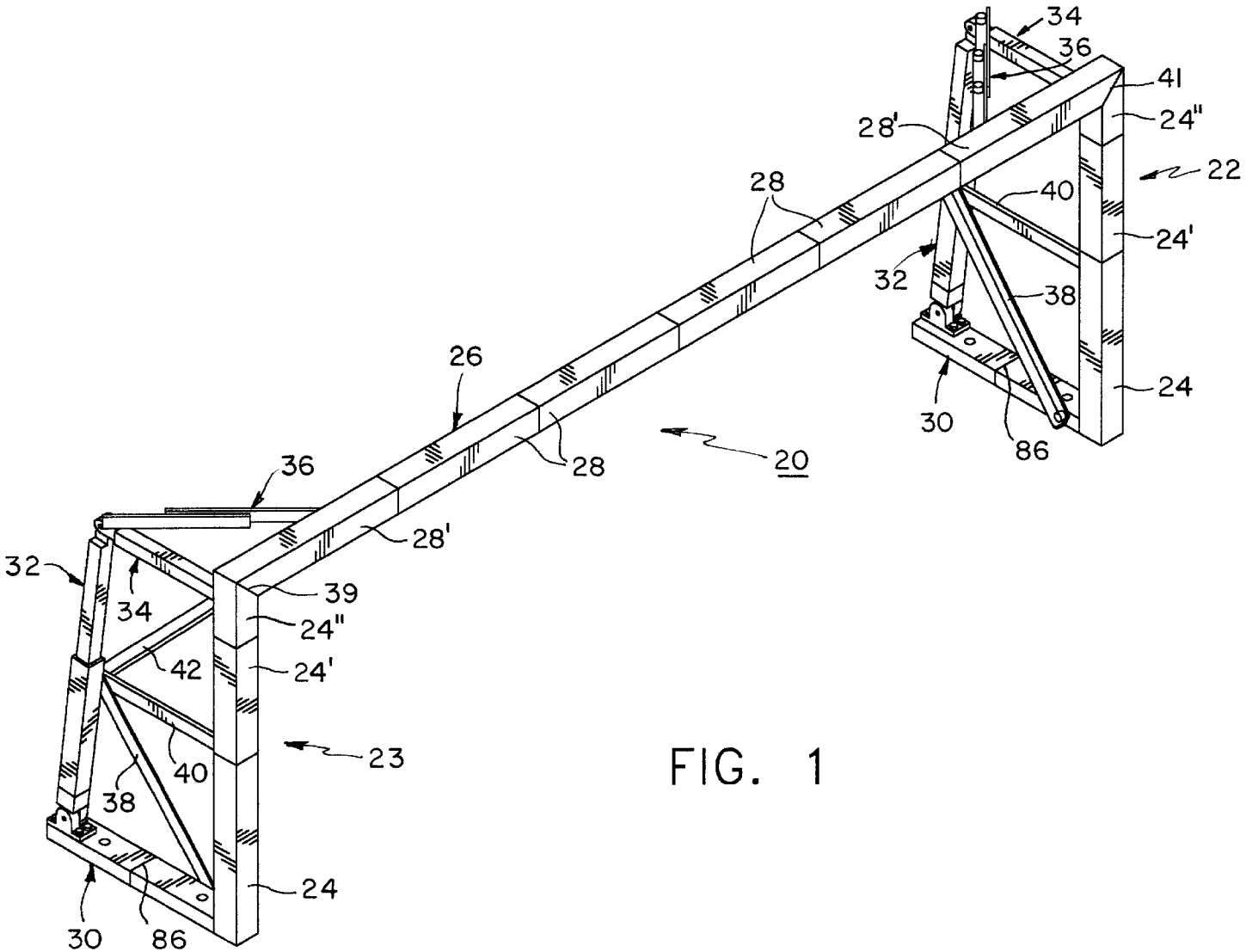
FIG. 1 is a front perspective view of my new and improved collapsible/portable soccer goal in a set-up condition.

Referring to the attached drawings, wherein like numerals are employed for like elements, and more particularly to FIGS. 1–16, there is shown an improved collapsible/portable soccer goal 20 of the present invention. As shown therein, it comprises a pair of vertical side frame supports 22, 23, each having adjacently disposed vertical sections 24, 24', 24", (for example, 4', 3' and 1' long each) which together with an elongated top beam 26 having a plurality of or six (4 feet long) adjacently disposed horizontal sections 28, 28', form a regulation 24 foot width soccer goal or a reduced, practice size goal post which has a smaller goal opening of 16 or 20 feet by the removal of one or two of the four foot horizontal sections, respectively.

Figure 15A:
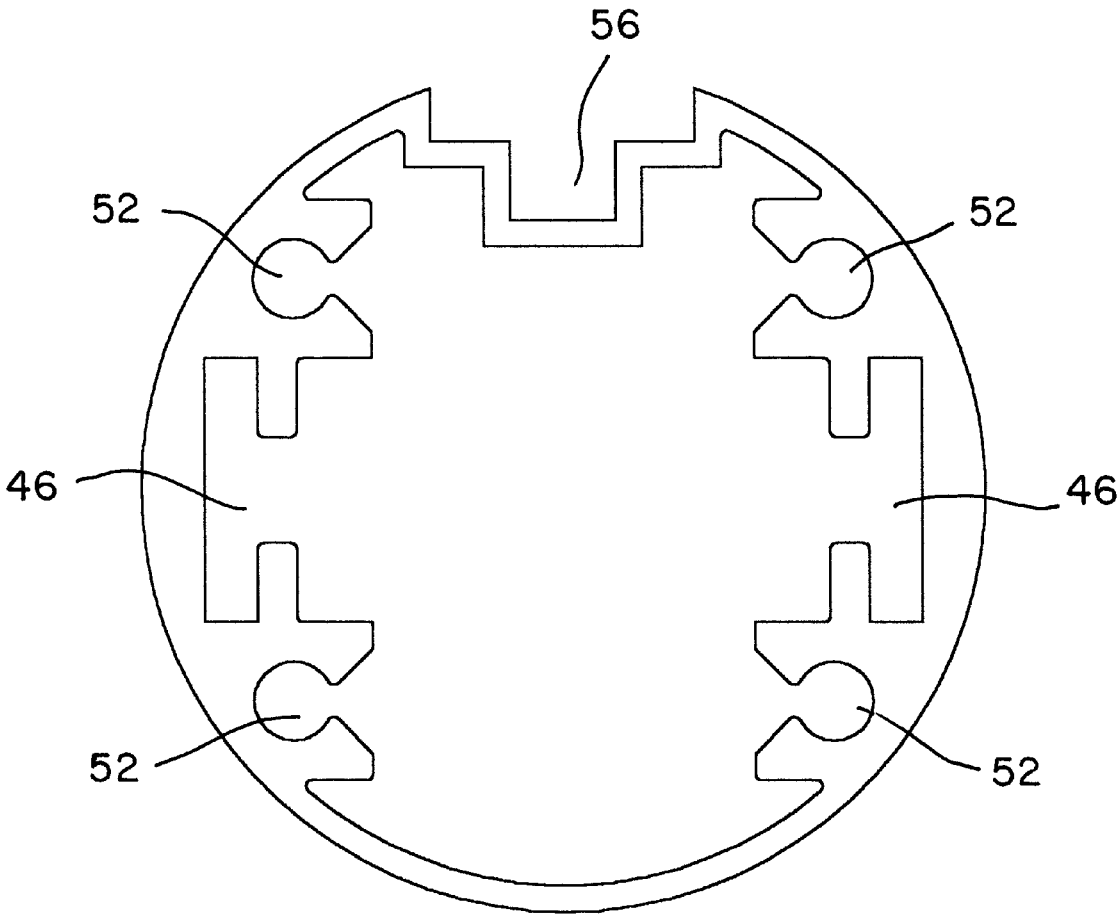
FIGS. 15A, 15B and 16 show typical goal post and beam profiles (round, oval and square, respectively), with FIG. 16 also showing one of many clips used to secure either a soccer net or kickback-screen to the two vertical goal posts and the horizontal beam forming the soccer goal.
Figure 15B:
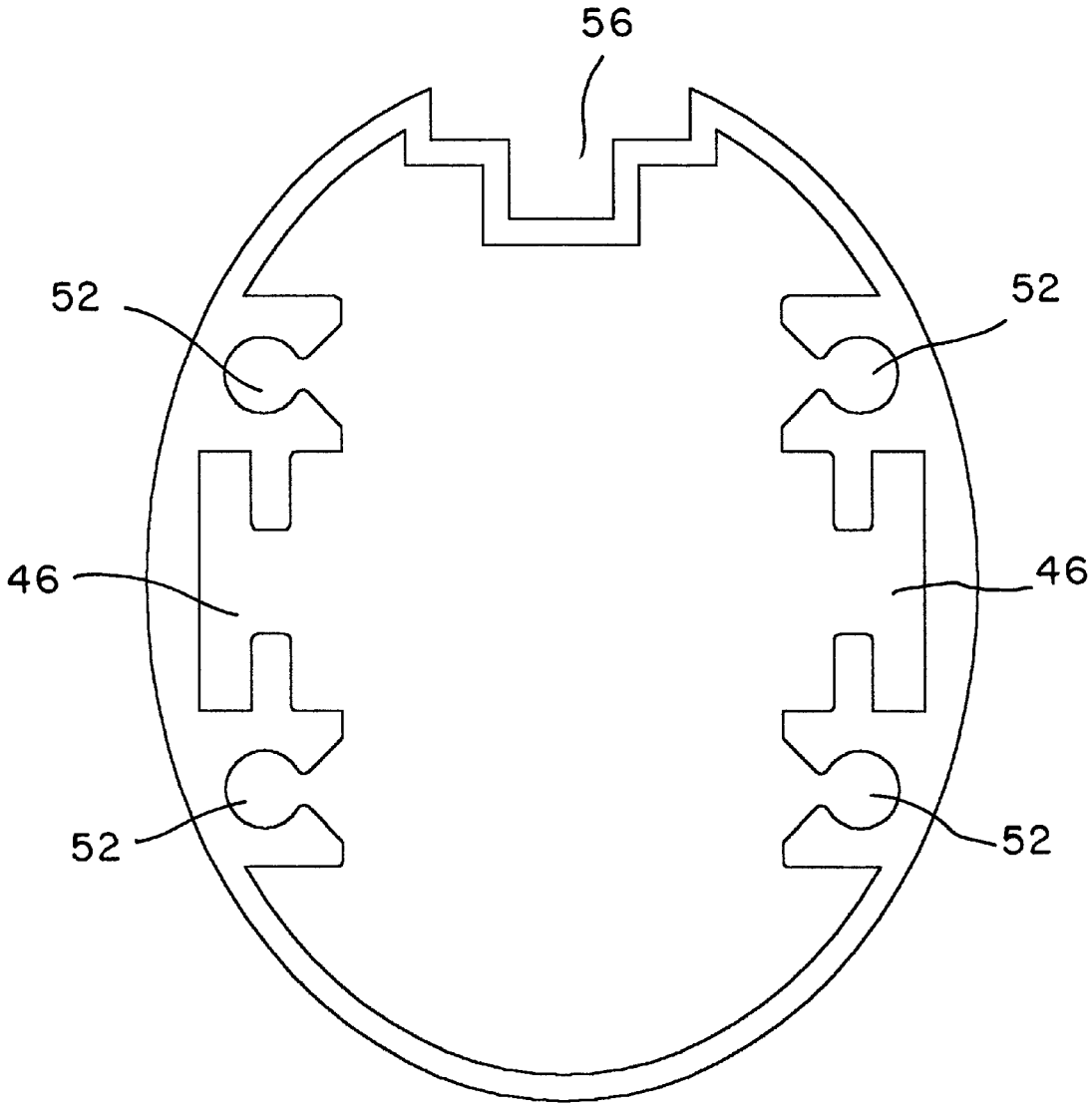
Figure 16:
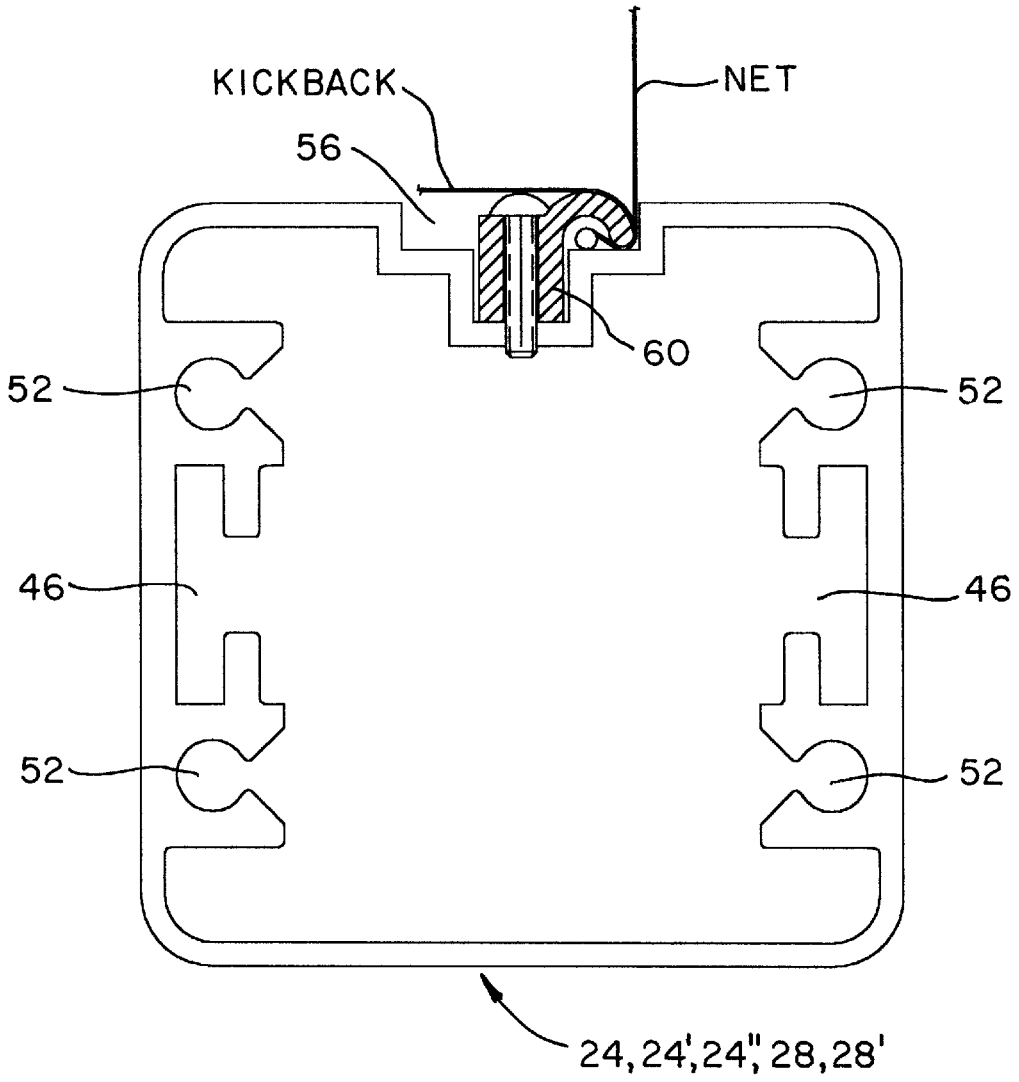

As best shown in FIGS. 1–12, each of the vertical side frame supports 22, 23 include a plurality of adjustable/extendible or telescoping struts 30, 32, 34 and 36 and suitably a plurality of fixed length struts 38, 40 and 42 (which may, if desired, also be adjustable/extendible or telescoping if one also prefers that the soccer goal be less than eight feet high, such as in a seven foot high goal used in practice by schools, colleges and/or other organizations). All of the horizontal and vertical sections have a 4 inch "face" (regulation width) whether the tubular form thereof is round, oval or square, as shown in FIGS. 15A, 15B and 16. Note also that while struts 32, 34 generally stay together when the goal post is disassembled, they may also be separated by removal of fastener 33.

Figure 13:
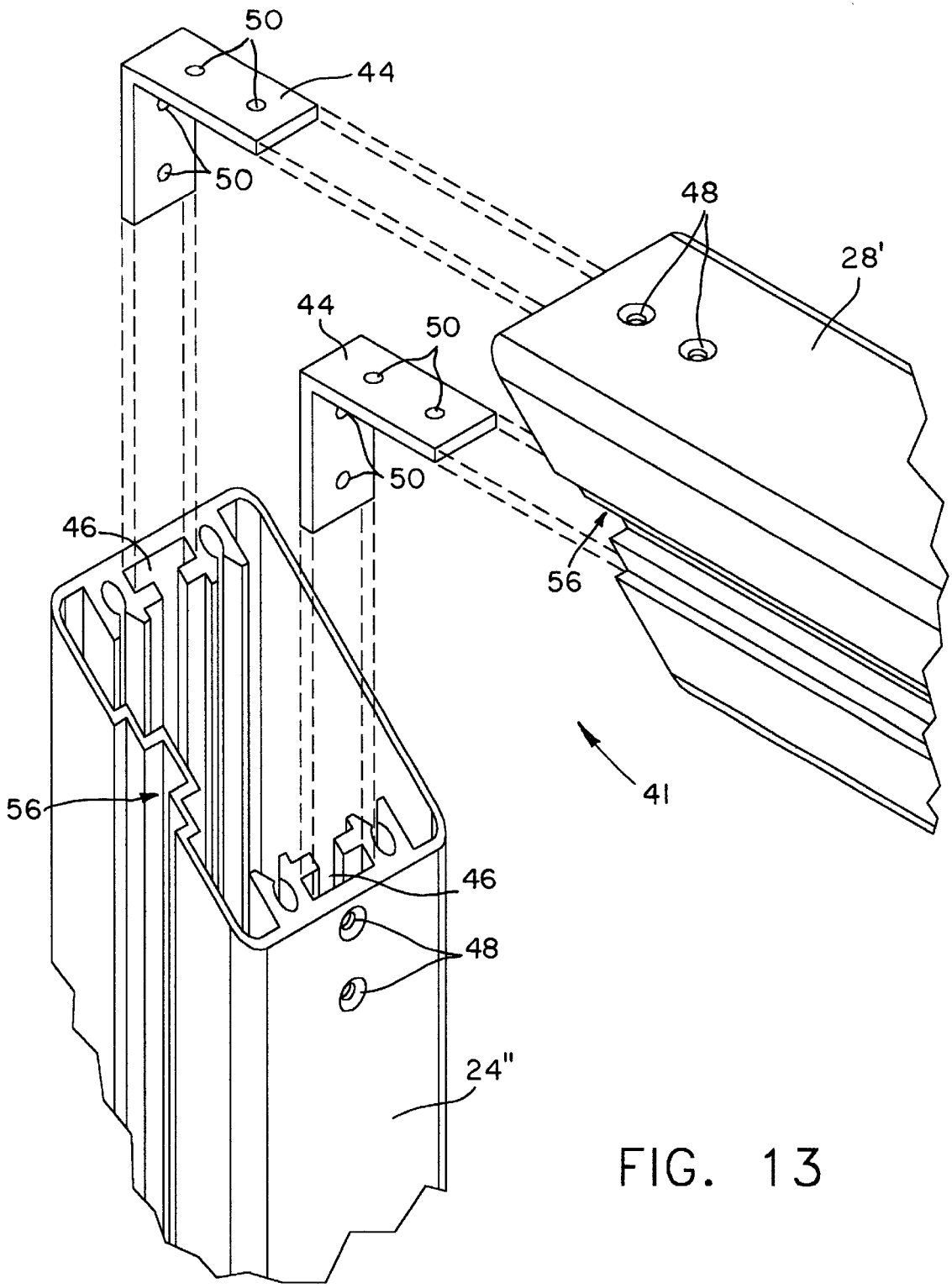
FIG. 13 is an enlarged fragmentary view of the corner connection between the top horizontal beam and the right side vertical goal post.
Figure 14:
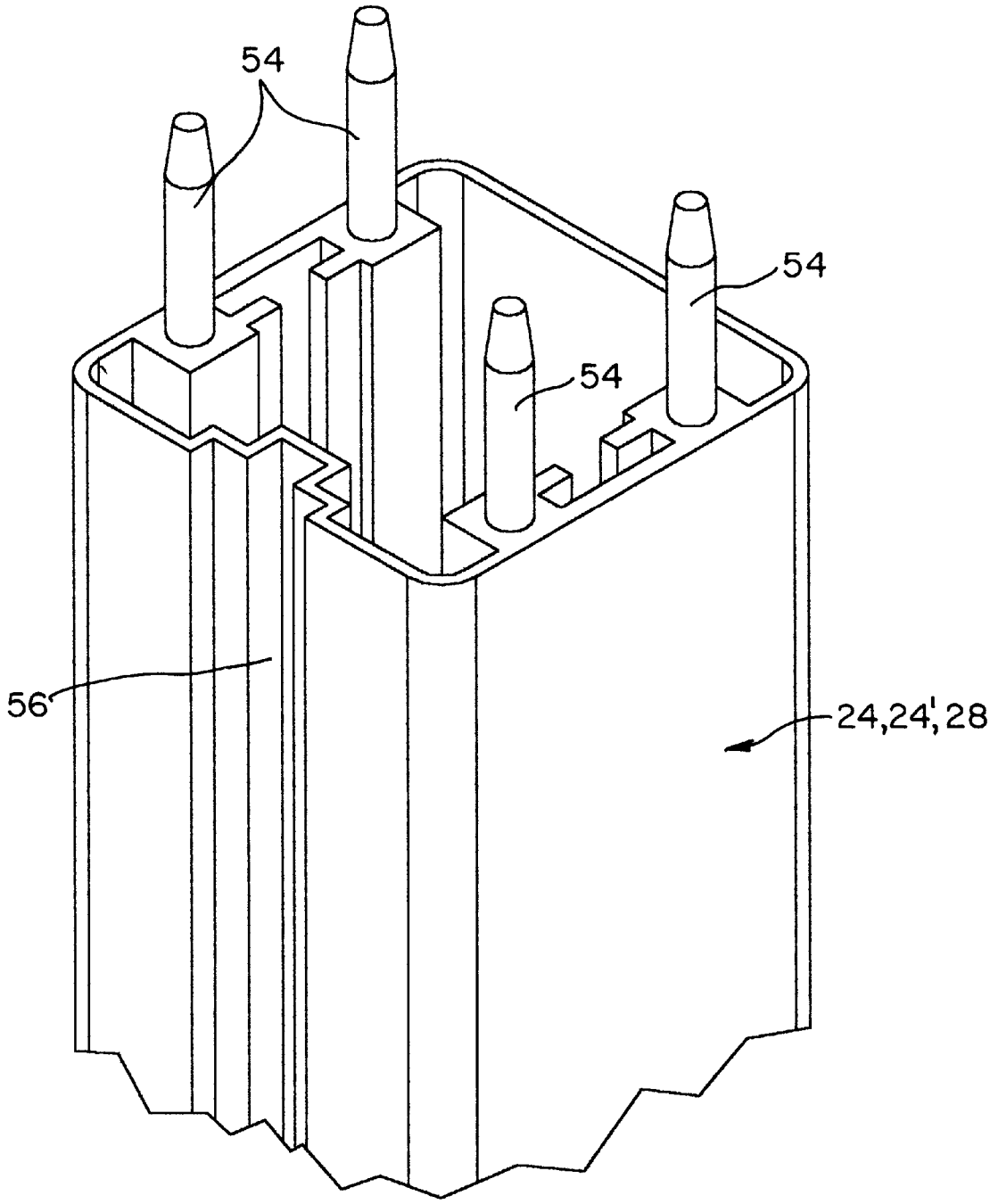
FIG. 14 is another enlarged fragmentary view of a typical connection between other mating parts of either the vertical goal post or the top horizontal beam.

In FIGS. 13 and 14, typical joints are illustrated. For example, the two top corner angular joints 39 and 41 (as shown in FIGS. 1, 3, 8 and 13) form 45° angles and the mating vertical section 24" and horizontal section 28' preferably have a plurality of right angle flat bars 44 mounted in slots 46 formed internally in both the tubular formed horizontal and vertical sections. Two flat bars 44 are shown secured in place by suitable fasteners (not shown) passing through apertures 48 in the sections and engaging with mating threaded holes, shown as apertures 50, in the right angle bars 44. Four round bars may be employed together with flat bars 44 or in place thereof, as shown in FIG. 14. The uppermost vertical end section 24" is suitably shorter than the remaining vertical sections 24 and 24'. The two vertical goal posts may be provided with at least a single one-foot section below section 24" (not shown) for enabling the goal post height to be adjustable, for example, from 8 feet to 7 feet (as is generally utilized for practice).

FIG. 14, 15A, 15B, and 16 suitably illustrate the employment of the four round apertures 52 used with four pins/bars 54 for aligning and maintaining "flush" joints between various sections of the goal post. The four pins/bars 54 with suitable tapered ends are fitted in the mating apertures 52 of both mating sections and are provided with a "snugtight" fit. Such pin/bar connectors 54 aid in holding the two mating sections together, and keep all of the vertical and horizontal sections straight "as an arrow", while preventing any bending of the posts and beam, particularly when under sudden impact by a ball or player. A greater or lesser number of pins/bars may be utilized as may be desired for the various joints. Also, suitable fasteners, such as set screws/mat (not shown), may be used to further secure in place said pins/bars 54, if desired.

Figure 2:
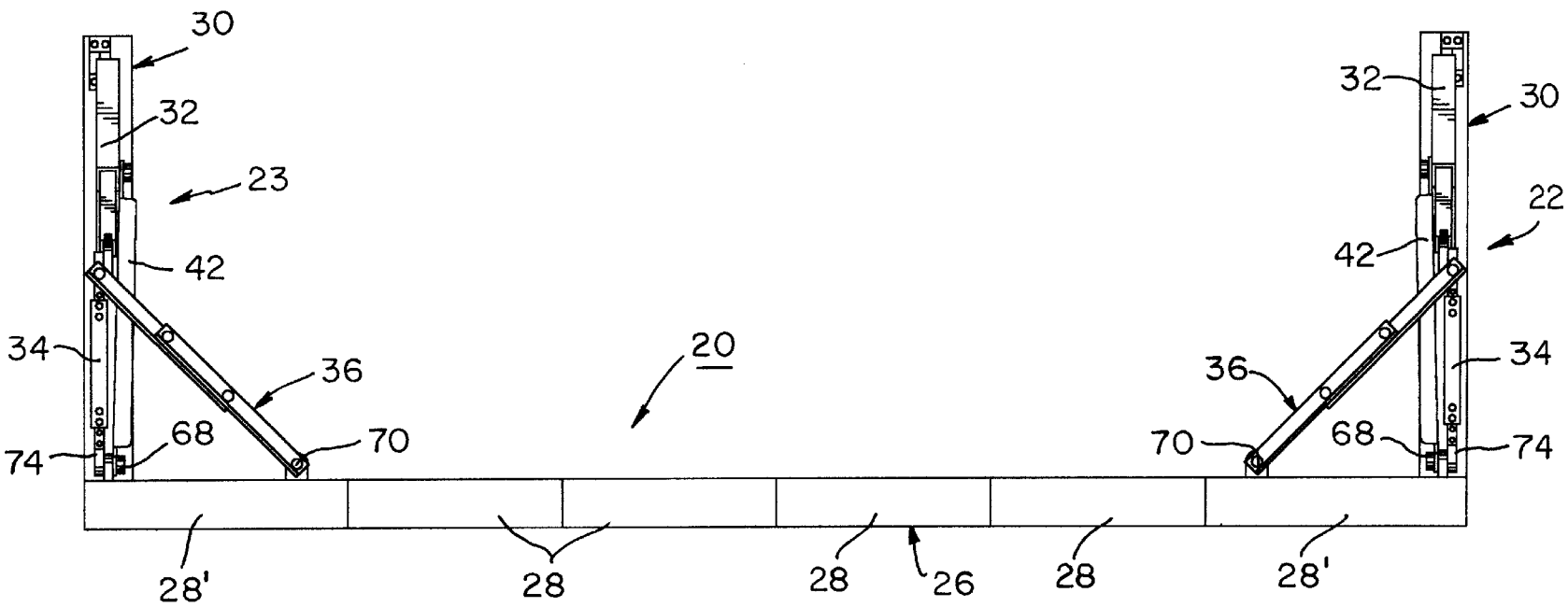
FIG. 2 is a top plan view thereof.
Figure 3:
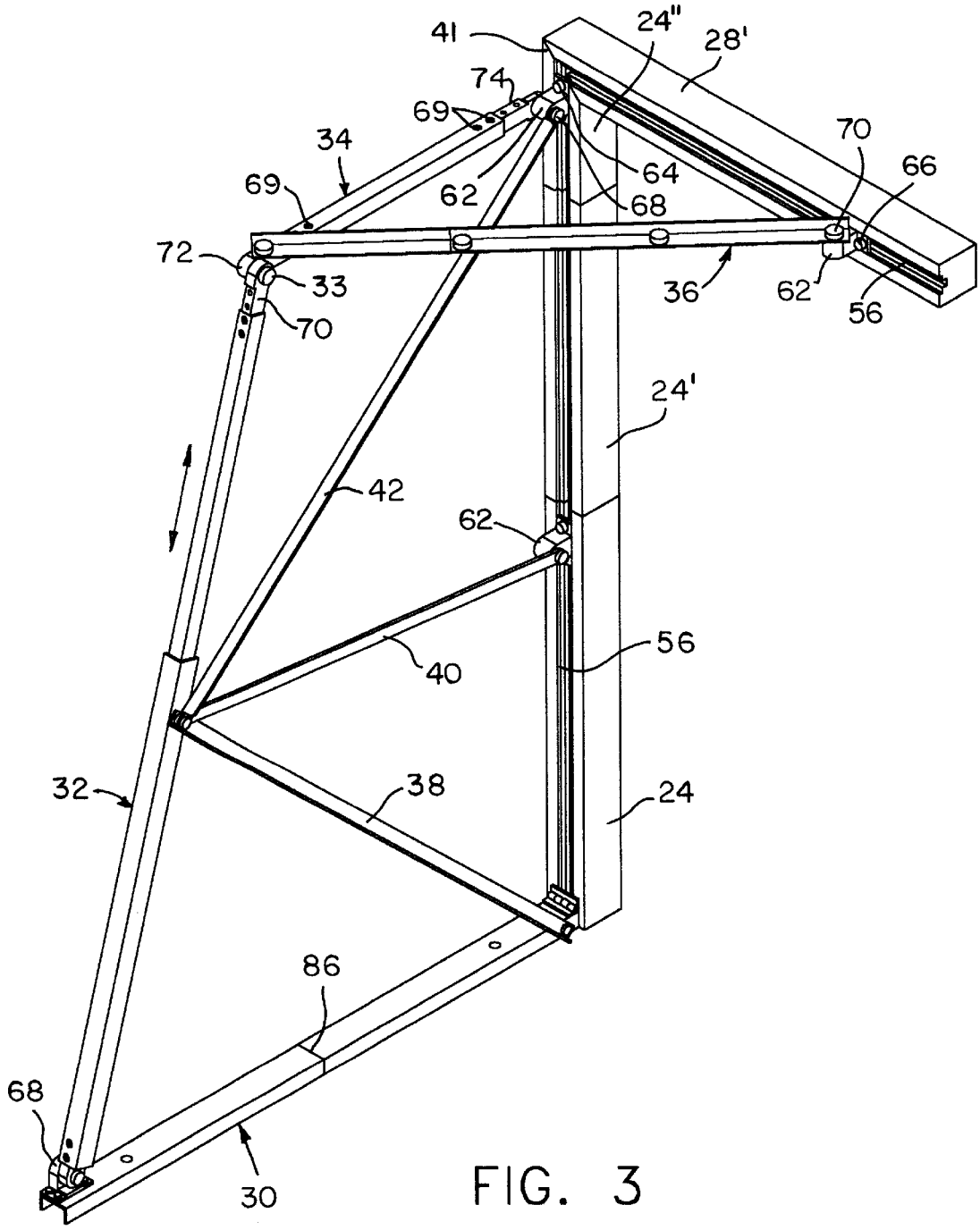
FIG. 3 is a right side supporting structure, in perspective, with the top horizontal beam shown "broken away"

All sections, vertical or horizontal, are further provided with groove means 56 at the back or rear surfaces 58 which extend inwardly toward the center axis of the tubular sections in such grooves 56 serve for holding latches as will be explained hereinafter, and are used for mounting the net and/or kick back screen by means of a plurality of J-shaped clips 60 (while both net and kick back are shown, only one is used at any one time). The groove means 56 are also further employed to mount the bracket 62 shown in FIG. 12E which is used to secure the front ends of the struts 34, 36 to both the vertical and horizontal sections 24', 28', respectively. Suitable fasteners 64 and 66 secure the brackets 62 to the vertical and horizontal sections, respectively (as best shown in FIGS. 2 and 3). Other suitable fasteners 68 and 70 provide the bracket to strut connection.

Figure 4:
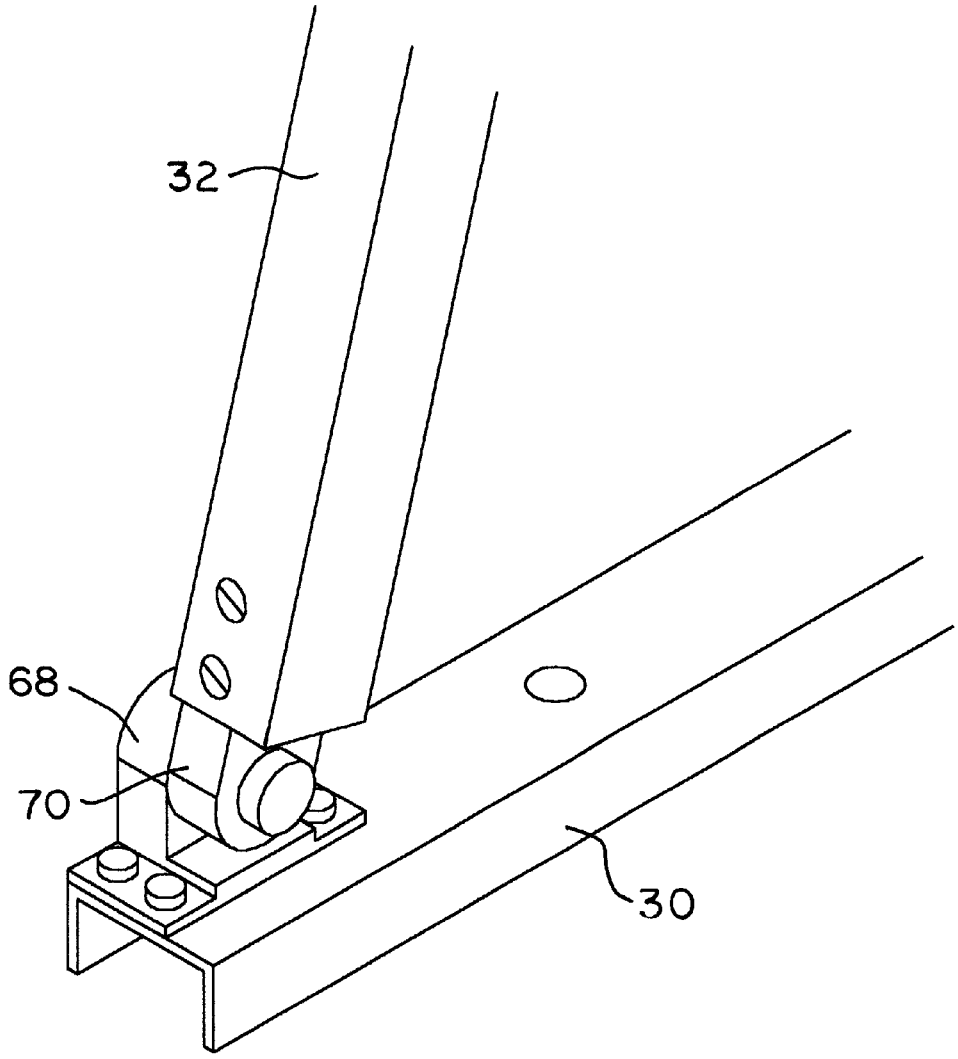
FIG. 4 is an enlarged partial view of the right side-rear bottom corner connection of the rear telescoping strut to the collapsible (folded) channel-shape bottom support member.

The bracket 62 is also used to mount the strut 40 to about the midpoint of the vertical (goal posts) sections 24, 24'. The bracket 68 is mounted to the extendible strut 30, and the telescoping strut 32 is connected at its lower end to such bracket 68. At the upper rear end of the strut 32, inserubrackets 70, 72 are used to mount the three adjustable/extendible or telescoping struts 32, 34 and 36, which all come together at such upper rear end of the collapsible/portable soccer goal. An enlarged detail of this upper rear end connection is clearly shown in FIGS. 7 and 11, as are all other connections and brackets or insert/brackets in FIGS. 4–6, 8–10, 12 and 13. The remaining insert/bracket 74 connects the strut 34 to the bracket 62 in the top front (right hand) corner of the soccer goal. The bracket 70 is also used to secure the lower rear end of strut 32 to the bracket 68 located on the extendible strut 30, as best shown in FIG. 4. Adjustable strut 34 is provided with a plurality of apertures 69 at both ends thereof for the adjustment of its overall length including that of its insert brackets 72, 74, and strut 30 is comprised of two equally long elements hinged together at joint 86 by means of a suitable hinge (not shown) mounted inside the U-shaped channel forming such strut 30.

Figure 6:
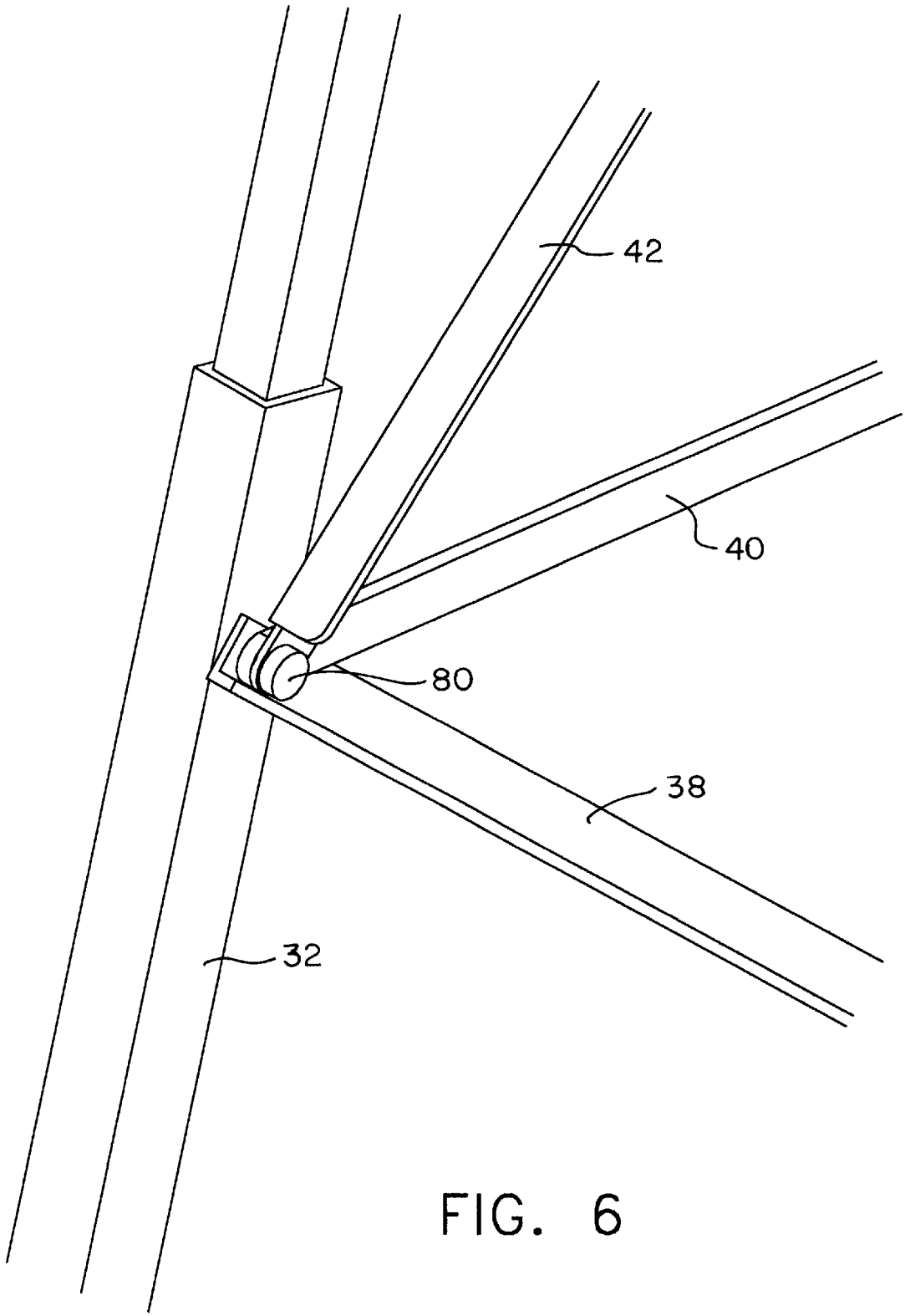
FIG. 6 is an enlarged partial view of the right side—rear center connection of the rear telescoping strut to the three reinforcing struts connected to the right vertical goal post.
Figure 7:
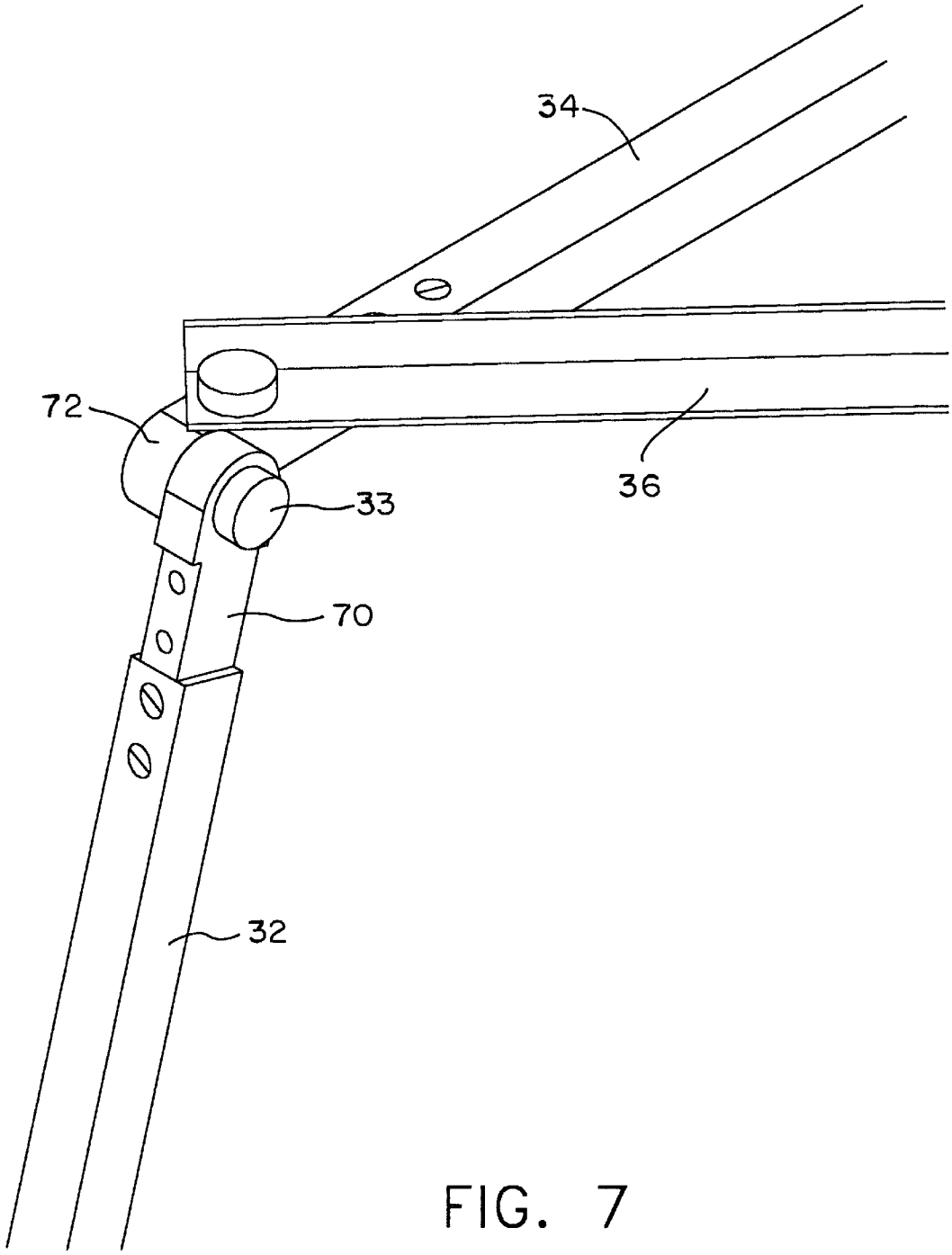
FIG. 7 is an enlarged partial view of the right side—rear top corner connection of the rear telescoping strut to the top right corner struts which form a right triangle with the top horizontal beam.
Figure 8:
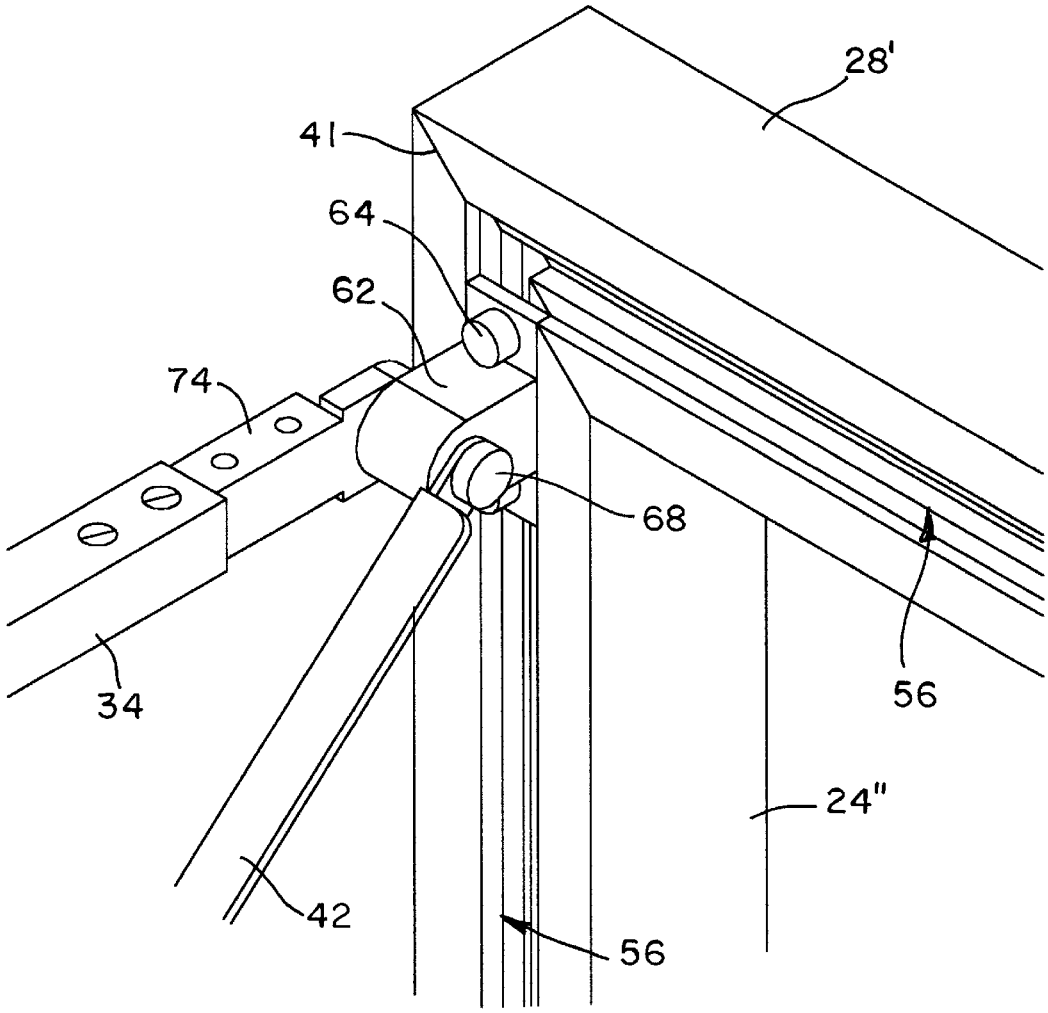
FIG. 8 is an enlarged partial view of the right side—front top cover connection of the right vertical goal post to the rearwardly extending top side struts.
Figure 9A:
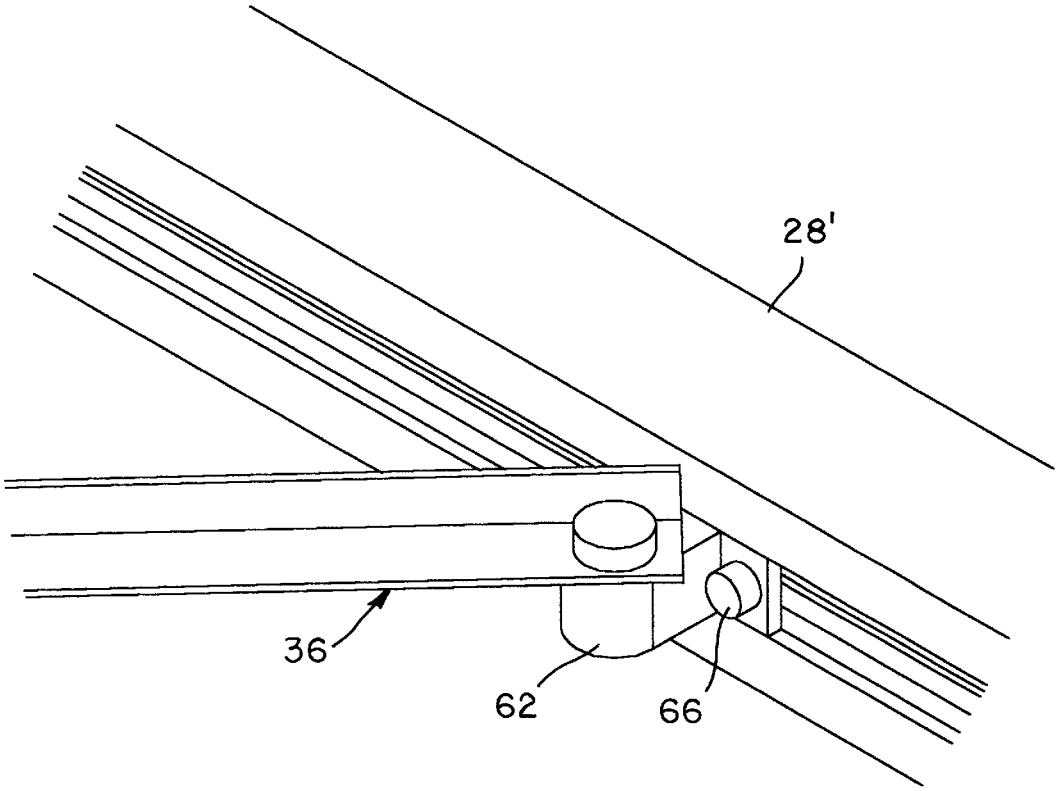
FIG. 9A is an enlarged partial view of the connection of the top side (bracing) strut to the top horizontal beam.
Figure 9B:
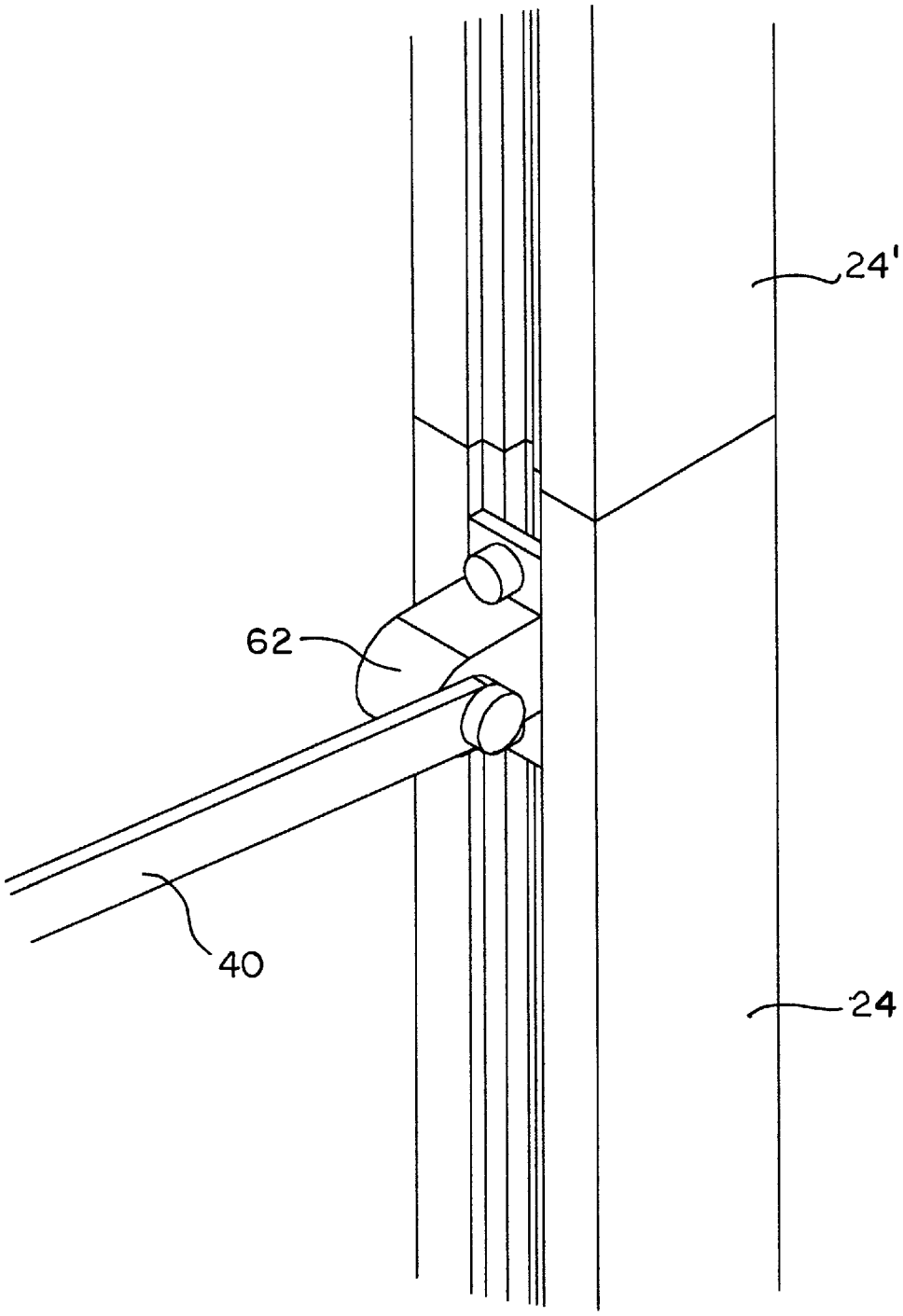
FIG. 9B is an enlarged partial view of the connection of the middle reinforcing strut to the right vertical goal post.
Figure 10:
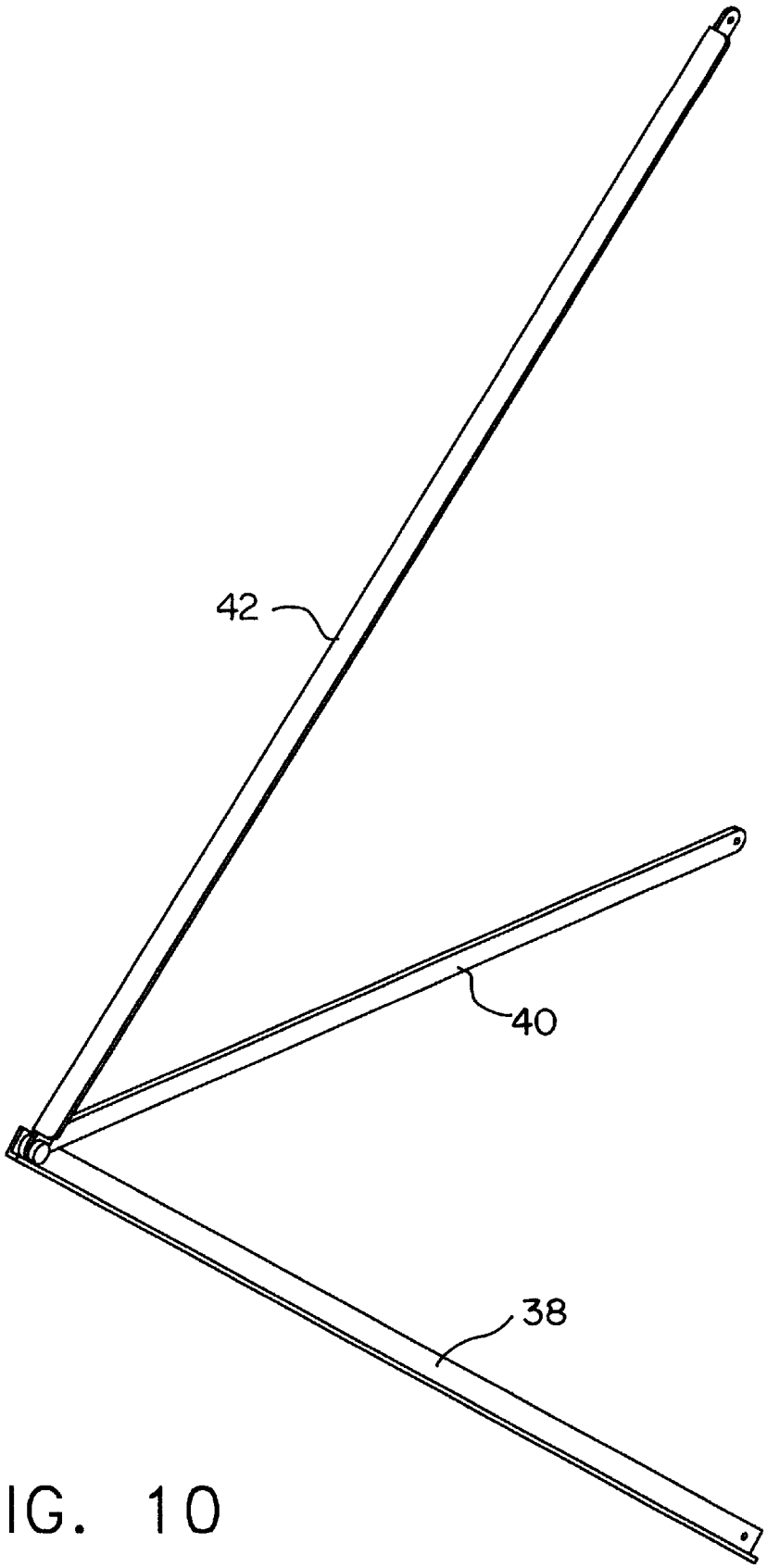
FIG. 10 is an enlarged partial view of the connection at the point where the three reinforcing struts are connected together.

In FIG. 6, the three fixed struts 38, 40 and 42 (which could also be adjustable/extendible or telescopic, as noted, should one desire to shorten the goalpost height by one foot to seven feet in lieu of a regulation eight foot height) are all simply mounted by a fastener 80 secured to a rear strut 32. With such a shorter goalpost, another vertical section of, say, one foot would need to be provided in order to readily lower the beam from eight feet to seven feet. The adjustable/extendible or telescoping struts would be of variable lengths enabling their reaching all brackets dependent upon the different goal post heights desired for practice and tournament play.

Figure 5:
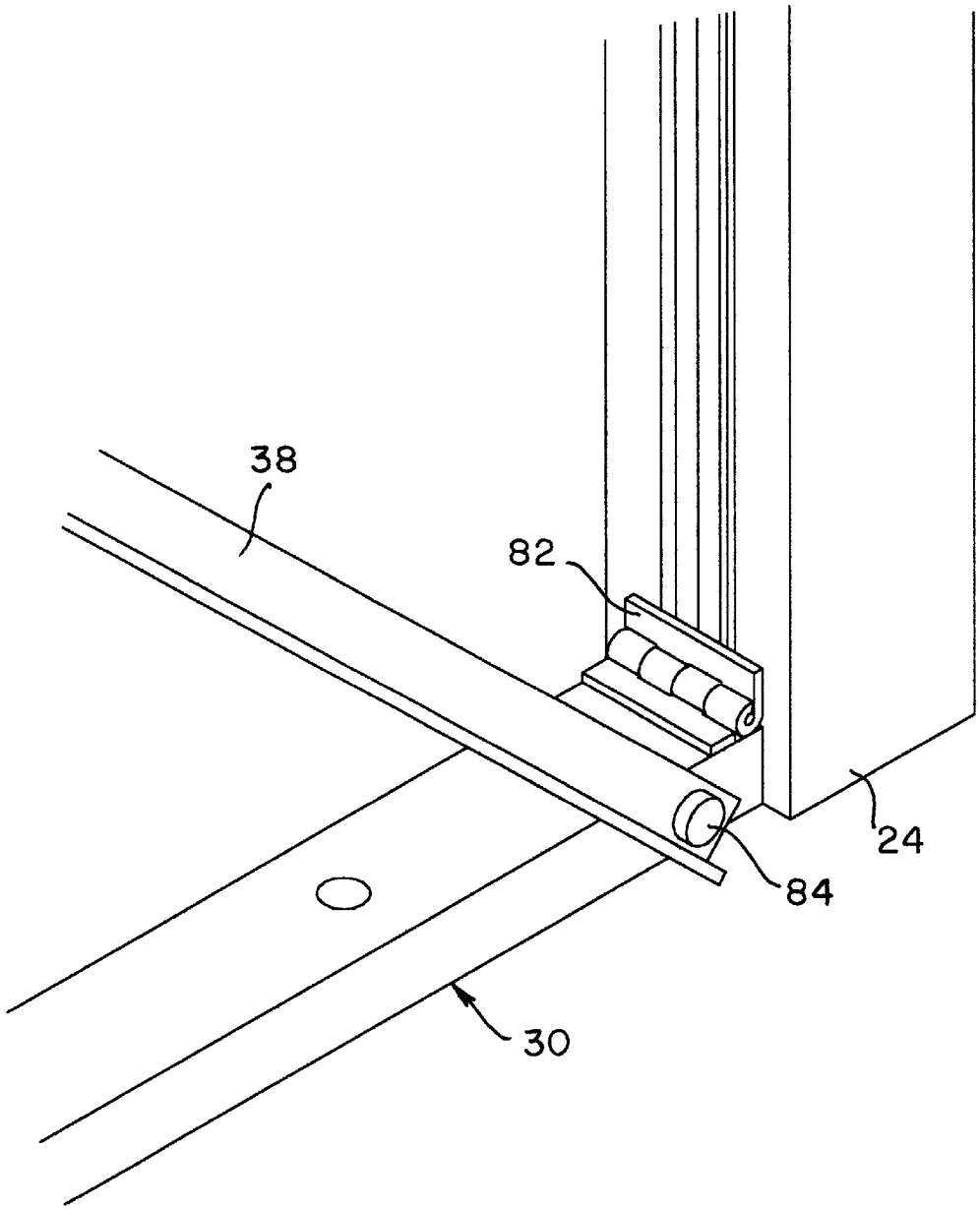
FIG. 5 is an enlarged partial view of the right side—front corner connection.

FIG. 5 shows one of the front vertical sections 24 suitably connected to extendible strut 30 by hinge means 82 with the strut 38 secured by fastener 84 to base strut 30. In this connection, it will be appreciated that the base strut is thus suitably made to hingedly fold about itself, as shown by the joint line 86, and suitable against the lower vertical section 24 for ease of storage/packaging and compactness.

The adjustable/extendible or telescopic struts may be of convention construction, such as square, round or other shaped profile with the "overall length" all of the various struts enabling all elements and parts and/or sub-assemblies of the goalpost to fit into a vehicle trunk or into a rear baggage area where the rear seat is removable or folds down. This will enable no one part of the portable goal to be longer than the depth or width of a large car trunk or hatchback area of a sedan or coupe where the rear seats project forward to enable long items, such as skis or fishing poles, to be placed or stored.

Figure 11:
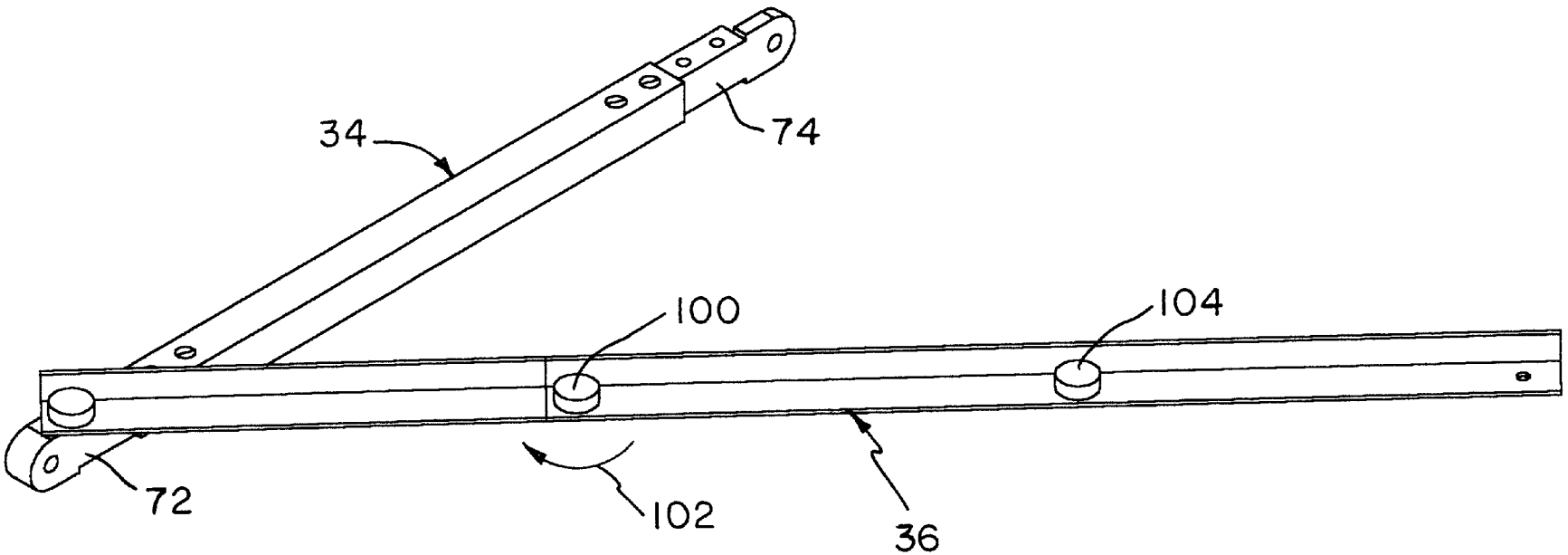
FIG. 11 is an enlarged partial view of the rear connection between the two rearwardly extending top side struts (without the rear telescoping strut)
Figure 12E:
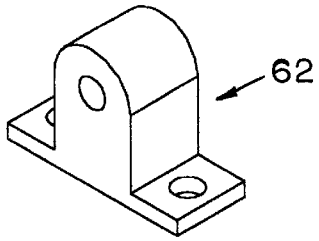
FIG. 12A to 12E are perspective views of the various brackets used to make the connections described and shown in the various figures dealing with "connections"
Figure 12D:
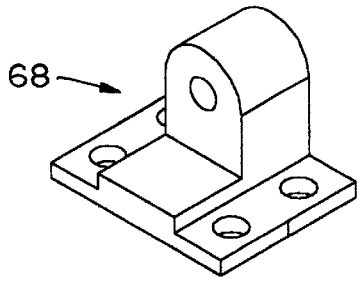
Figure 12C:
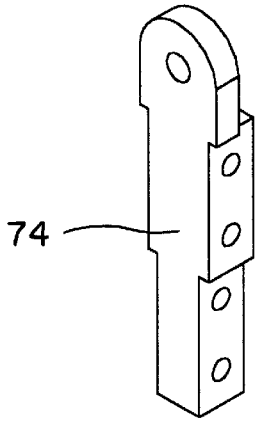
Figure 12A:
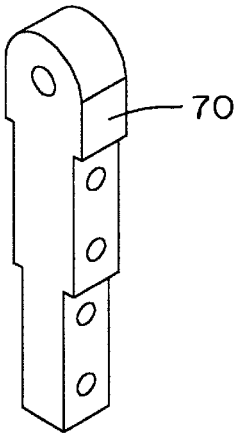
Figure 12B:
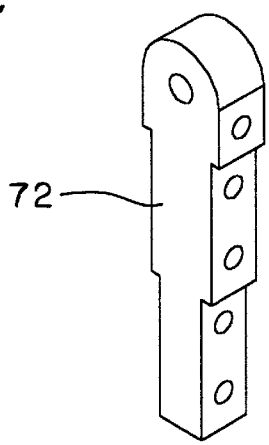

Also, it will be appreciated that anchoring stakes or auger mounts (not shown) may be employed with the present invention in order to securely hold the soccer goal to the ground. In a like manner, latch means, such as the Southern latch, which has a keeper, is available from the Reid Tool Supply Company and may be employed in the groove means 56 about the joints between the sections to hold same tightly together. This is particularly desirable in the vertical sections wherein one can conceivable be pinched in a minute gap that may open up ever so slightly at a joint in the event of a hard kicked soccer ball or player impacting directly against or at an angle to the goal posts. Of course, while latches are also employed at all of the joints in the horizontal beam, any such "pinching" is clearly out of reach as said beam is normally eight feet above ground. In addition, the groove means 56 may be provided deeply within the tubular sections so that clamping of the latches at each joint is closer to the axis of the tubular sections. Such arrangement provides for a better joint as locking of the two adjacently disposed sections is near the axis of the sections and not near the outer peripheral wall surfaces. Also, insert bracket 70, 72 and 74 all enable their mating strut adjustable/extendible and is analogous to the telescoping strut 32 insofar as my invention is concerned. Moreover, while I show alternate tubular sizes (small and large) for each insert bracket, one size may be employed so that all of the apertures illustrated (four shown) may be used to provide an even greater length for the adjustment feature, in lieu of telescoping tubes. Furthermore, the angles adjustable/extendible or telescoping strut 36, as shown in FIGS. 3 and 11, pivots about fastener 100 as shown by arrow 102 when fastener 104 is removed for storage or transporting same to a site for assembly with strut 34 being maintained held to strut 32 by the fastener 33.

While a tubular square form of section, such as shown in FIG. 16, is shown in FIGS. 1–14, both the round (FIG. 15A) and the oval (FIG. 15B) are alternative forms for use as vertical and horizontal sections as long as they meet the NCAA regulation, which specifies that all goal posts must have four 4 inch face widths.

It will also be appreciated in the practice of the invention that the corner joints (24" and 28"), may if desired, be welded together so as to greatly reduce assembly time, and also to aid in packaging and/or storage as a few of the remaining vertical and horizontal sections may be "tied" along side with each other to minimize the size of a packed bundle of parts.

Although the present invention has been described in some detail by way of illustration and example for purposes of clarity and understanding, it will, of course, be understood that various charges and modifications may be made with the form, details and arrangements of the parts without departing from the scope of the invention as set forth in the following claims.

What I claim:

1. A collapsible soccer goal, comprising:

vertical side frame supports each having a pair of adjacently disposed vertical sections;

an elongated top beam having a plurality of adjacently disposed horizontal sections including opposite end sections resting atop said pair of vertical sections;

said vertical and horizontal sections formed as hollow tubular elements with joints, including corner joints formed by said elongated top beam with said pair of vertical sections, and said adjacently disposed sections joined together by a plurality of bar means;

each said vertical side frame support further including at least a plurality of adjustable/extendible or telescoping struts; and said plurality of adjustable/extendible or telescoping struts forming a truss-like structure connectable to a vertical section for supporting, said vertical and horizontal sections as a unitary soccer goal in a vertical upright position orthogonal to ground, wherein said adjustable/extendible or telescoping struts have opposite ends, and comprise top and rear struts fastened together at a common top end connection, and at their opposite ends to a vertical section, and to an adjustable/extendible or telescoping base strut connected to said vertical section, and including a plurality of fixed length struts connected together at one end, and to about mid-point of said rear adjustable/extendible or telescoping strut, so as to generally form a pair of right triangular frames with a common side strut extending about perpendicular to said vertical section.

2. The collapsible soccer goal of claim 1, further including corner struts connecting said corner joints with said elongated top beam.

3. The collapsible soccer goal of claim 2, wherein said corner struts are collapsible for storage.

4. The collapsible soccer goal of claim 1, wherein said plurality of fixed length struts are three, and pivot generally together about said one end so as to minimize storage space when said fixed length struts are stored together as a unit apart from the adjustable/extendible or telescoping struts and said sections.

5. The collapsible soccer goal of claim 1, wherein said plurality of fixed length struts are angular in form.

6. The collapsible soccer goal of claim 2, wherein said vertical and horizontal sections have generally continuous groove means.

7. The collapsible soccer goal of claim 6, further including a plurality of brackets mounted to said groove means for connection with said top and corner struts, and to a plurality of said fixed struts.

8. The collapsible soccer goal of claim 7, wherein one of said fixed length struts is attached to said base strut.

9. The collapsible soccer goal of claim 6, including a net having edges secured to said groove means in said horizontal and vertical sections for capturing a soccer ball passing within said soccer goal.

10. The collapsible soccer goal of claim 9, further including a plurality of clips for holding the edges of said net in said groove means.

11. The collapsible soccer goal of claim 6, further including latch means mounted to said groove means for maintaining improved joint connections between said sections.

12. A collapsible soccer goal, comprising:

vertical side frame supports each having a pair of adjacently disposed vertical sections;

an elongated top beam having a plurality of adjacently disposed horizontal sections including opposite end sections resting atop said pair of vertical sections;

said vertical and horizontal sections formed as hollow tubular elements with joints, including corner joints formed by said elongated top beam with said pair of vertical sections, and said adjacently disposed sections joined together by a plurality of bar means;

each said vertical side frame support further including at least a plurality of adjustable/extendible or telescoping struts; and said plurality of adjustable/extendible or telescoping struts forming a truss-like structure connectable to a vertical section for supporting said vertical and horizontal sections as a unitary soccer goal in a vertical upright position orthogonal to ground, wherein said adjustable/extendible or telescoping struts have opposite ends, and comprise top and rear struts fastened together at a common top end connection, and at their opposite ends to a vertical section, and to an adjustable/extendible or telescoping base strut connected to said vertical section, and wherein each of said base struts is made of two base members hinged together, and at one end thereof to a bottom end of said vertical sections which contact the ground.

13. The collapsible soccer goal of claim 12, wherein said base members are formed of channel-shaped elements.

14. The collapsible soccer goal of claim 12, including means for securing said base struts to ground.

15. A collapsible soccer goal, comprising:

vertical side frame supports each having a pair of adjacently disposed vertical sections;

an elongated top beam having a plurality of adjacently disposed horizontal sections including opposite end sections resting atop said pair of vertical sections;

said vertical and horizontal sections formed as hollow tubular elements with joints, including corner joints formed by said elongated top beam with said pair of vertical sections, and said adjacently disposed sections joined together by a plurality of bar means;

each said vertical side frame support further including at least a plurality of adjustable/extendible or telescoping struts; and said plurality of adjustable/extendible or telescoping struts forming a truss-like structure connectable to a vertical section for supporting said vertical and horizontal sections as a unitary soccer goal in a vertical upright position orthogonal to ground, wherein said vertical and horizontal sections are tubular in form wherein said sections having internally formed passageways for mounting said plurality of bar means which secure said vertical and horizontal sections together, wherein said bar means for the corner joints are flat bars, and wherein said bar means for all other joints between said vertical and horizontal sections are a plurality of round bars.

16. The collapsible soccer goal of claim 15, wherein said plurality of round bars have tapered ends.

* * * * *